United States Patent [19]

Kurt

[11] Patent Number: 4,729,439

[45] Date of Patent: Mar. 8, 1988

[54] GANG DRILL CONSTRUCTION

[75] Inventor: Ewald H. Kurt, Roanoke, Va.

[73] Assignee: Ingersoll-Rand Company, Woodcliff Lake, N.J.

[21] Appl. No.: 922,626

[22] Filed: Oct. 24, 1986

[51] Int. Cl.[4] ..... E21B 4/16

[52] U.S. Cl. ..... 175/96; 175/417

[58] Field of Search ..... 175/95, 96, 318, 296, 175/202, 203, 414, 108, 53, 415, 417

[56] References Cited

U.S. PATENT DOCUMENTS

| | | | |
|---|---|---|---|
| 3,144,086 | 8/1964 | Kurt et al. | 175/96 |
| 3,297,099 | 1/1967 | Adams et al. | 175/96 |
| 3,387,673 | 6/1968 | Thompson | 175/96 |
| 3,682,258 | 8/1972 | Kelly, Jr. et al. | 175/96 |
| 4,084,646 | 4/1978 | Kurt | 173/17 |
| 4,478,296 | 10/1984 | Richman, Jr. | 175/92 |

*Primary Examiner*—Stephen J. Novosad
*Assistant Examiner*—David J. Bagnell
*Attorney, Agent, or Firm*—W. C. Vliet

[57] ABSTRACT

Disclosed is a new method of construction for multiple or gang down hole rock drills. A rigid mounting cylinder with alignment and securing means for the individual drills is provided. The cylinder further serves to attach the multiple drills to a single drill string which supplies air to the individual drills. The cylinder further facilitates rock chip removal by filling all but the peripheral annulus which forms the exit channel for exhaust air.

4 Claims, 5 Drawing Figures

GANG DRILL CONSTRUCTION

BACKGROUND AND OBJECT OF THE INVENTION

Down the hole (downhole) drills have found wide acceptance in drilling rock in hole sizes to twenty four (24) inches. In larger sizes economics of producing the limited numbers involved have further limited down hole drill acceptance.

It is therefore an object of this invention to produce an effective down hole drill of larger diameter and lower cost.

An object of the invention is to effectively combine or gang a plurality of smaller economically manufactured drills in a versatile package suitable for drill string attachment as a down the hole drill.

These and other objects are obtained in a gang drill for rock boring and the like comprising:

An assembly of a plurality of rock drills in a drill casing. The casing being further provided with alignment means and securing means for each of the drills of the plurality of drills.

DESCRIPTION OF THE PREFERRED EMBODIMENT

Figure 1:
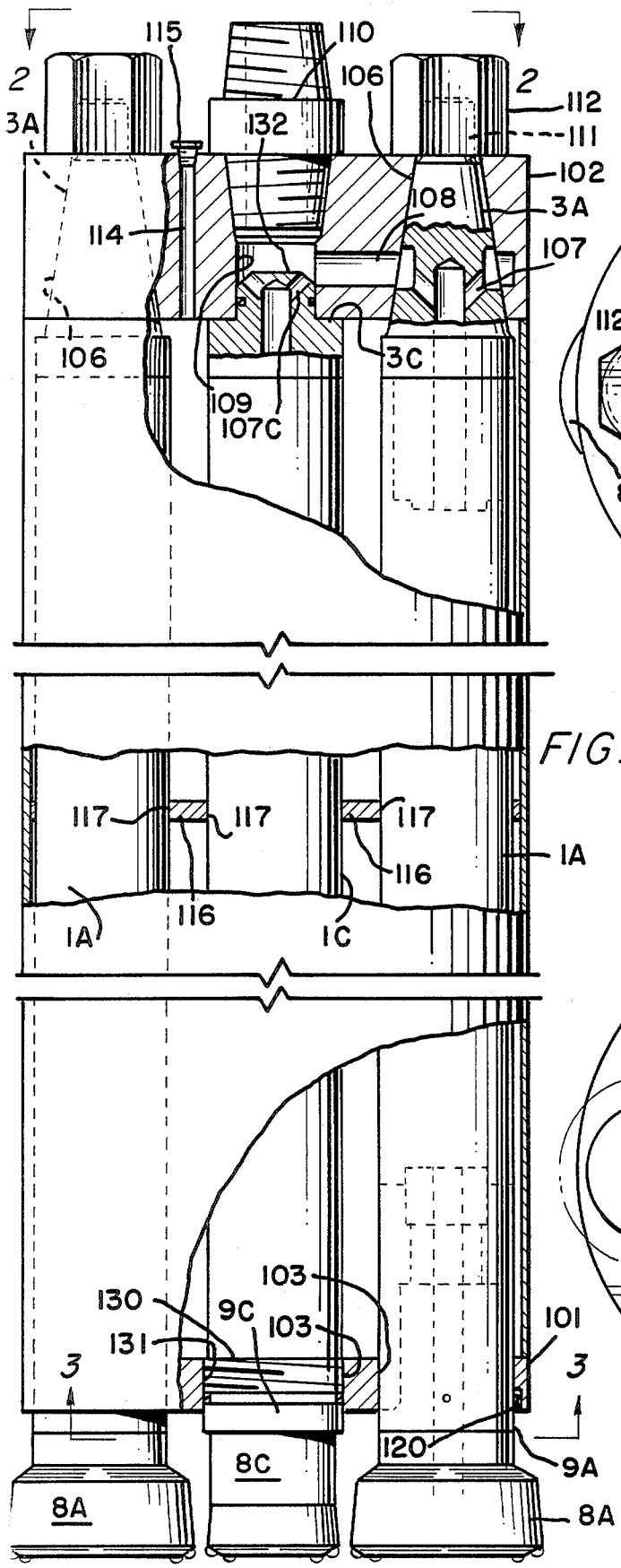
FIG. 1 is a longitudinal section of a gang drill according to the invention.

Referring now to FIG. 1, the gang down hole drill of the present invention is shown for purpose of understanding the invention in terms of a preferred embodiment. The embodiment shown comprises an exterior cylinder casing 100 having a disc shaped key plate 101 attached by well known means such as welding at its one end and a disc shaped end plate 102 attached by well known means at its other end. In the embodiment shown the key plate is provided with five straight through circular bores 103. The end plate is similarly provided with four tapered circular bores 104 in the periphery and one compound bore in the center in spaced apart, axial and radial register with the bores in the key plate.

Inserted in each of the peripheral bores is a down the hole fluid actuated impact tool or drill 1 of the type described in U.S. Pat. No. 4,084,646 issued to Ewald Heinz Kurt and assigned to Ingersoll-Rand Company. The drill 1 is provided with a modified back head 3A and a modified drill chuck 9A. Otherwise, the drill may be considered as described in U.S. Pat. No. 4,084,646 in both structure and function and that description is incorporated herein by reference.

Figure 2:
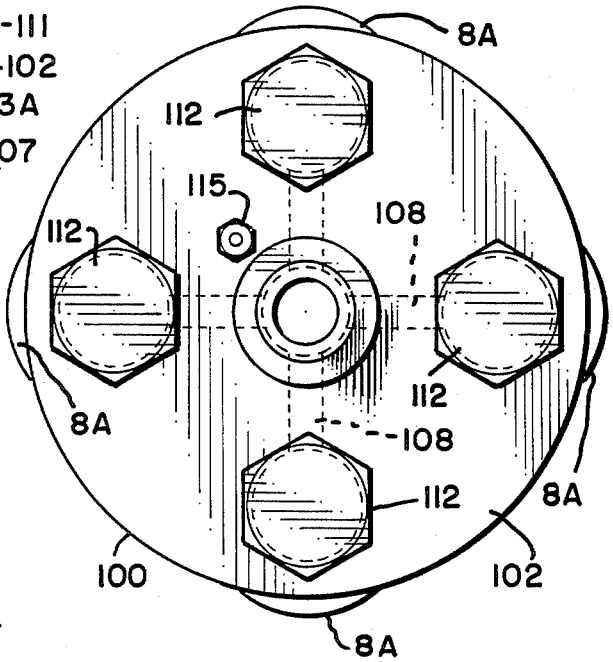
FIG. 2 is a top end view of the gang drill.
Figure 3:
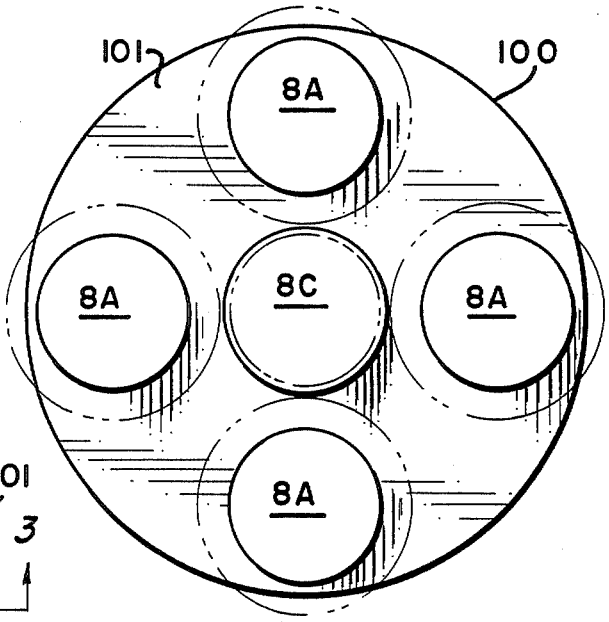
FIG. 3 is a bottom end view of the gang drill.

As best seen in FIGS. 1 and 2 the modified back head of each peripheral drill is provided with a taper 106 having interconnecting bores 107 which mate with pressure fluid supply bores 108 in the end plate 102. The pressure fluid supply bores 108 connect with the central pressure fluid supply bore 109 which receives pressure fluid from a conventional drill string not shown via the connecting pipe thread coupling 110.

The modified backhead 3A extends through the end plate 102 and terminates in a thread 111 which is used to secure the rock drill 1 to the end plate by the co-action of the taper 106 and threaded cap nut 112.

The end plate 102 is further provided with a relief bore 114 which is closed by a relief valve 115 whose function is to maintain a slight positive pressure in the drill casing 100. The drill casing 100 is further provided with a centralizing support plate 116 which like the key plate 10, and the end plate 102, are provided with five circular through bores 117. The centralizing plate 116 is welded to the casing 100 in spaced apart axial and radial register with the bores in the key plate 101 and end plate 102.

Figure 4:
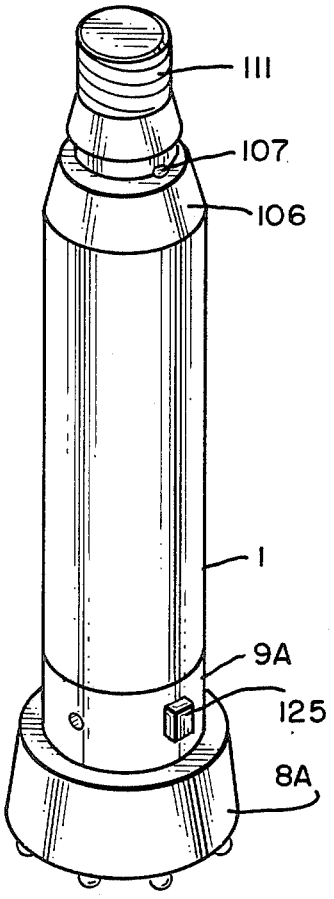
FIG. 4 is a perspective view of the modified individual drill used in the gang drill.
Figure 5:
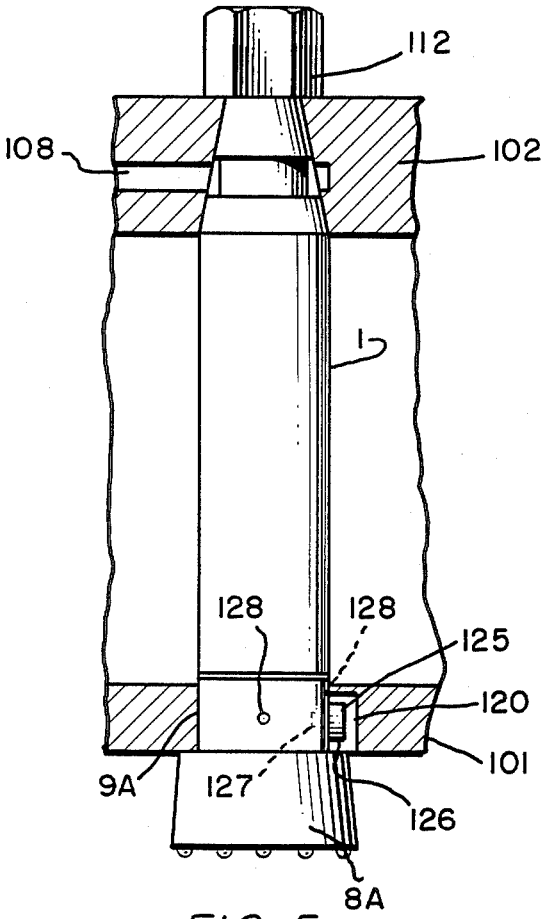
FIG. 5 is a detailed view of the chuck key inserted in the chuck plate.

As best seen in FIGS. 4 and 5 each of the peripheral bores in the key plate 101 is further provided with a key notch 120 which accepts a key 125 having a cylindrical portion 126 and a rectangular portion 127 as shown on FIG. 4. The rectangular portion 127 fits in the key notch 120 and when the drill 1 is drawn tightly into the taper of end plate 102 by means of the thread 111 and thread cap nut 112 provide a locking means for preventing rotation of the drill 1 within the casing 100 during normal operation. The circular portion 126 of the key 125 is inserted in the drill chuck of the conventional drill in a circular bore 128 which according to the present invention is provided for that purpose.

In the drill chuck 9A, it should be appreciated by one skilled in the art that the key 125 in cooperation with the square notch 120 in the key plate 101 and the circular bore 128 in the drill chuck 9A prevents rotation of the individual down the hole drills 1 in the gang drill casing 100.

The center drill 1C is of similar construction to the peripheral drills 1 and is provided with a modified drill chuck 1C and a modified backhead 3C. The modified drill chuck 1C has an external thread 130 which cooperates with a threaded bore 131 in the key plate. The threaded combination retains the center drill. In the gang drill casing the backhead 3C is provided with a centralizing boss 132 which is disposed in assembled configuration in the bore 109 which supplies pressure fluid to both the central drill and the peripheral drills. In the gang drill combination, pressure fluid is supplied from bore 109 to the central drill 1C through pressure fluid bores 107C provided in the backhead 3C.

In the preferred embodiment shown the drill bit 8A is of slightly larger diameter than the drill for the peripheral drills while the central drill 1C is provided with a drill bit 8C which is of approximately the same diameter as the central drill. The larger diameter drill bits 8A provide the necessary overlap of the gang drill casing 100 required to permit the casing 100 to pass into the bored hole. Use of the smaller diameter bit on the central drill is for convenience in the present package arrangement. The size of the center drill should be selected to permit approximately equal cutting advance with the peripheral drills while minimizing the open or non-active cutting space on the drill face.

As can be appreciated by one skilled in the art, the present invention provides a means of ganging a number of smaller diameter rock drills in a convenient and aligned package to bore larger size holes. The package further permits use with conventional drill strings having a single central pressure fluid supply and string mounting means.

Having now described my invention in terms of a preferred embodiment, however, I do not wish to be limited in the scope of my invention except as claimed.

I claim:

1. A gang drill for rock boring and the like comprising:

an assembly of a plurality of individual percussion producing rock drills in a cylindrical drill casing having a top end connected to a drill string and a bottom end adjacent rock boring bits operatively associated with each of said drills; said casing totally enclosing said percussive producing rock drills, and being further provided with alignment means, securing means, and means for supplying pressure fluid for each of said drills of said plurality of drills, said pressure fluid entering said drills internal of said casing and exiting said drills external to said casing at its bottom end whereby said casing forms a peripheral passage for the exiting of rock cuttings and provides protection for said drills.

2. The gang drill according to claim 1 further characterized in said casing having inserted therein a center drill and a plurality of peripheral drills.

3. The gang drill according to claim 2 further characterized in the each of said peripheral drills is provided with an alignment taper at one end, means for securing said peripheral drills to a mating alignment plate at one end of said casing having corresponding tapers, and a locking means at its other end for securing said peripheral drills against rotation within said gang drill casing.

4. The gang drill according to claim 3 where in said locking means comprises a key inserted between said peripheral drill and a key plate at the other end of said casing.

* * * * *